US009731173B2

(12) United States Patent
Bezilla et al.

(10) Patent No.: US 9,731,173 B2
(45) **Date of Patent: *Aug. 15, 2017**

(54) GOLF CLUB HEAD AND REMOVABLE WEIGHT

(71) Applicant: Acushnet Company, Fairhaven, MA (US)

(72) Inventors: Stephanie Bezilla, Carlsbad, CA (US); Thomas Orrin Bennett, Carlsbad, CA (US); Stephen S. Murphy, Carlsbad, CA (US); Gery M. Zimmerman, Fallbrook, CA (US)

(73) Assignee: Acushnet Company, Fairhaven, MA (US)

( * ) Notice: Subject to any disclaimer, the term of this patent is extended or adjusted under 35 U.S.C. 154(b) by 169 days.

This patent is subject to a terminal disclaimer.

(21) Appl. No.: 14/616,582

(22) Filed: Feb. 6, 2015

(65) Prior Publication Data

US 2015/0151172 A1 Jun. 4, 2015

Related U.S. Application Data

(63) Continuation of application No. 14/033,282, filed on Sep. 20, 2013, now Pat. No. 8,951,145, which is a continuation of application No. 12/852,732, filed on Aug. 9, 2010, now Pat. No. 8,540,589, which is a continuation-in-part of application No. 12/337,051, filed on Dec. 17, 2008, now Pat. No. 8,192,302, which is a continuation-in-part of application No. 12/130,435, filed on May 30, 2008, now Pat. No. 7,771,290.

(51) Int. Cl.
*A63B 53/04* (2015.01)
*A63B 53/06* (2015.01)

(52) U.S. Cl.
CPC ..... *A63B 53/04* (2013.01); *A63B 53/0466* (2013.01); *A63B 53/06* (2013.01); *A63B 53/047* (2013.01); *A63B 53/0487* (2013.01); *A63B 2053/0433* (2013.01); *A63B 2053/0491* (2013.01); *A63B 2053/0495* (2013.01)

(58) Field of Classification Search
USPC ..... 473/324–350
See application file for complete search history.

(56) References Cited

U.S. PATENT DOCUMENTS

| | | | |
|---|---|---|---|
| 80,435 | A | 7/1868 | Way |
| 996,937 | A | 7/1911 | Mulock |
| 1,167,106 | A | 1/1916 | Palmer |

(Continued)

FOREIGN PATENT DOCUMENTS

| | | |
|---|---|---|
| GB | 2133295 | 7/1984 |
| JP | 10137374 | 5/1998 |

(Continued)

*Primary Examiner* — Alvin Hunter
(74) *Attorney, Agent, or Firm* — Michael J. Mancuso

(57) ABSTRACT

A golf club head and a removable weight that is received in a receptacle of the golf club head. The weight includes a cap and a slug. The cap is removably coupled to the receptacle and includes a recess that receives a portion of the slug so that the cap and slug are able to rotate relative to each other. The slug includes an anti-rotation feature that prevents relative rotation between the slug and the receptacle and a lead-in portion.

20 Claims, 17 Drawing Sheets

(56) References Cited

U.S. PATENT DOCUMENTS

| | | | | |
|---|---|---|---|---|
| 2,545,045 | A | 3/1951 | Rosan | |
| 3,212,783 | A | 10/1965 | Bradley et al. | |
| 3,259,404 | A | 7/1966 | Papenguth | |
| 3,466,047 | A | 9/1969 | Rodia et al. | |
| 3,604,755 | A | 9/1971 | Krekeler | |
| 3,652,094 | A | 3/1972 | Glover | |
| 3,692,306 | A | 9/1972 | Glover | |
| 4,026,183 | A | 5/1977 | Bart | |
| 4,043,563 | A | 8/1977 | Churchward | |
| 4,052,075 | A | 10/1977 | Daly | |
| 4,194,547 | A | 3/1980 | Sidor et al. | |
| 4,443,145 | A | 4/1984 | Peschges | |
| 4,450,904 | A | 5/1984 | Volz | |
| 4,538,790 | A | 9/1985 | Williams et al. | |
| 4,958,970 | A | 9/1990 | Rose et al. | |
| 5,154,424 | A | 10/1992 | Lo | |
| 5,168,767 | A | 12/1992 | Morita | |
| 5,236,164 | A | 8/1993 | Lorizzo | |
| 5,320,005 | A | 6/1994 | Hsiao | |
| 5,547,326 | A | 8/1996 | Overhues | |
| 5,860,779 | A | 1/1999 | Toosky et al. | |
| 5,904,460 | A | 5/1999 | Kawabata | |
| 6,017,177 | A | 1/2000 | Lanham | |
| 6,089,994 | A | 7/2000 | Sun | |
| 6,296,574 | B1 | 10/2001 | Kaldis | |
| 6,306,048 | B1 | 10/2001 | McCabe et al. | |
| 6,348,014 | B1 | 2/2002 | Chiu | |
| 6,379,265 | B1 | 4/2002 | Hirakawa et al. | |
| 6,436,142 | B1 | 8/2002 | Paes et al. | |
| 6,719,510 | B2 | 4/2004 | Cobzaru | |
| 6,773,360 | B2 | 8/2004 | Willett et al. | |
| 6,811,496 | B2 | 11/2004 | Wahl et al. | |
| 7,083,530 | B2 | 8/2006 | Wahl et al. | |
| 7,121,956 | B2 | 10/2006 | Lo | |
| 7,166,040 | B2 | 1/2007 | Hoffman et al. | |
| 7,179,034 | B2 | 2/2007 | Ladouceur | |
| 7,186,190 | B1 | 3/2007 | Beach et al. | |
| 7,223,180 | B2 | 5/2007 | Willett et al. | |
| 7,294,065 | B2 | 11/2007 | Liang et al. | |
| 7,351,161 | B2 | 4/2008 | Beach | |
| 7,407,447 | B2 | 8/2008 | Beach et al. | |
| 7,410,425 | B2 | 8/2008 | Willett et al. | |
| 7,410,426 | B2 | 8/2008 | Willett et al. | |
| 7,419,441 | B2 | 9/2008 | Hoffman et al. | |
| 7,452,285 | B2 | 11/2008 | Chao et al. | |
| 7,530,904 | B2 | 5/2009 | Beach et al. | |
| 7,540,811 | B2 | 6/2009 | Beach et al. | |
| 7,568,985 | B2 | 8/2009 | Beach et al. | |
| 7,578,753 | B2 | 8/2009 | Beach et al. | |
| 7,628,711 | B2 | 12/2009 | Akinori et al. | |
| 7,632,194 | B2 | 12/2009 | Beach et al. | |
| 7,670,235 | B2 | 3/2010 | Lo | |
| 7,713,142 | B2 | 5/2010 | Hoffman et al. | |
| 7,717,804 | B2 | 5/2010 | Beach et al. | |
| 7,717,805 | B2 | 5/2010 | Beach et al. | |
| 7,744,484 | B1 * | 6/2010 | Chao | A63B 53/0466 473/324 |
| 7,771,290 | B2 | 8/2010 | Bezilla et al. | |
| 7,775,905 | B2 | 8/2010 | Beach et al. | |
| 8,192,302 | B2 | 6/2012 | Knutson et al. | |
| 8,540,589 | B2 * | 9/2013 | Bezilla | A63B 53/04 473/335 |
| 8,753,227 | B1 * | 6/2014 | Cackett | A63B 53/06 411/383 |
| 8,926,449 | B2 * | 1/2015 | Sato | A63B 53/06 473/334 |
| 8,951,145 | B2 * | 2/2015 | Bezilla | A63B 53/04 473/334 |
| 8,998,747 | B2 * | 4/2015 | Cackett | A63B 53/06 411/383 |
| 2004/0092332 | A1 | 5/2004 | Willett et al. | |
| 2006/0100029 | A1 | 5/2006 | Lo | |
| 2006/0122004 | A1 | 6/2006 | Chen | |
| 2008/0015049 | A1 * | 1/2008 | Imamoto | A63B 53/0466 473/338 |
| 2008/0039229 | A1 | 2/2008 | Lo | |
| 2008/0132353 | A1 | 6/2008 | Hsiao | |
| 2008/0146370 | A1 | 6/2008 | Beach | |
| 2014/0018184 | A1 | 1/2014 | Bezilla et al. | |

FOREIGN PATENT DOCUMENTS

| | | | |
|---|---|---|---|
| JP | 10234902 | | 9/1998 |
| JP | 10248964 | | 9/1998 |
| JP | 11319167 | | 11/1999 |
| JP | 2000005350 | | 1/2000 |
| JP | 2000176059 | | 6/2000 |
| JP | 2001149514 | | 6/2001 |
| JP | 2005160947 | | 6/2005 |
| JP | 2006081862 | | 3/2006 |
| JP | 2006122334 | | 5/2006 |
| JP | 2006187489 | | 7/2006 |
| JP | 2007313304 | | 12/2007 |
| JP | 2013233346 | A * | 11/2013 |

* cited by examiner

GOLF CLUB HEAD AND REMOVABLE WEIGHT

CROSS-REFERENCE TO RELATED APPLICATIONS

This application is a continuation of U.S. patent application Ser. No. 14/033,282, filed Sep. 20, 2013, which is a continuation of U.S. patent application Ser. No. 12/852,732, filed Aug. 9, 2010, now U.S. Pat. No. 8,540,589, which is a continuation-in-part of U.S. patent application Ser. No. 12/337,051, filed Dec. 17, 2008, now U.S. Pat. No. 8,192,302, which is a continuation-in-part of U.S. patent application Ser. No. 12/130,435, filed May 30, 2008, now U.S. Pat. No. 7,771,290, the contents of which are incorporated in their entirety by reference herein.

FIELD OF THE INVENTION

This invention generally relates to golf club heads, and more specifically to golf club heads including a removable weight.

BACKGROUND OF THE INVENTION

Removable weights have been incorporated into golf club heads to distribute discretionary mass in order to alter the performance characteristics of the golf clubs. For example, weights may be incorporated to provide adjustability in characteristics such as swing weight, location of the center of gravity and manipulation of the moment of inertia of a particular golf club head. Various weight designs have been utilized that allow the manufacturer and/or consumer to alter the mass properties of a golf club head.

One example of a weight incorporated into a club head is described in U.S. Pat. No. 1,167,106 to Palmer for a Golf Club. Palmer describes a golf club that includes a threaded opening that receives threaded weight plugs for varying the weight of a cast metal golf club head. The threaded opening extends through a rear wall of the golf club head and receives a threaded plug which may be just long enough to fill the opening or it may extend further into the golf club head to increase the weight. The threaded opening is tapered so that the plug may be tightened to a desired depth. A disadvantage of the threaded weight plug is that it is constructed as a single piece. As a result, torque applied to the weight plug during use of the golf club is transmitted to the threaded portion and may result in the weight plug becoming disengaged, especially with repeated use.

Another example of a removable weight is described in U.S. Pat. No. 6,773,360 to Willett et al. for a Golf Club Having a Removable Weight. The removable weight includes a mass element and a fastener that extends through an aperture in the mass element. A golf club head body includes an interior cavity and a recess on a wall of the body. Inside the recess, a threaded opening is provided so that the fastener may extend through the mass element disposed in the recess and into the threaded opening to fasten the mass element in the recess. Because the fastener extends through the mass element and into a threaded opening in the recess, the size of the mass element and the structure of the recess are limited. Additionally, the mass element is visible to the user when installed so less variation is available for the mass element without detrimentally affecting the aesthetics of the club head.

It is desirable to provide a golf club head and a weight member that allows additional design freedom for the weight while creating fewer restrictions on the golf club head design.

SUMMARY OF THE INVENTION

The invention is directed to a golf club head and a removable weight. Several embodiments of the present invention are described below.

In an embodiment, a golf club head comprises a body and a weight. The body includes a weight receptacle that includes a cap portion and a seat portion. The cap portion is disposed proximate an outer surface of the body and the seat portion is spaced from the outer surface of the body. The weight comprises a cap and a slug. The cap includes a base and a sidewall that extends from the base to define a recess. The cap is removably coupled to the cap portion of the weight receptacle and comprises an aperture extending entirely through the base from an outer surface of the base to the recess of the cap. The slug is an elongate member and includes a retention portion and an extension portion. At least a portion of the retention portion is disposed in the recess of the cap when the weight is installed in the weight receptacle. The extension portion includes a tapered portion that is at least partially disposed in the seat portion of the weight receptacle when the weight is installed in the weight receptacle.

In another embodiment, golf club head comprises a body and a weight. The body includes a weight receptacle that includes a cap portion and a seat portion. The cap portion is disposed proximate an outer surface of the body and the seat portion is spaced from the outer surface of the body. The weight comprises a cap and a slug. The cap includes a base and a sidewall that extends from the base to define a recess, and the cap is removably coupled to the cap portion of the weight receptacle. The slug is an elongate member and includes a retention portion and an extension portion, and at least a portion of the retention portion is disposed in the recess of the cap. The extension portion includes a tapered portion that is at least partially disposed in the seat portion of the weight receptacle when the weight is installed in the weight receptacle. The retention portion of the slug comprises a projection including a tapered contact surface that abuts the cap, and the cap includes a tapered contact surface that abuts the tapered contact surface of the slug.

In a further embodiment, golf club head comprises a body and a weight. The body includes a weight receptacle, and the weight receptacle includes a cap portion and a seat portion. The cap portion is disposed proximate an outer surface of the body and the seat portion is spaced from the outer surface of the body. The weight comprises a cap and a slug. The cap includes a base and a sidewall that extends from the base to define a recess, and the cap is removably coupled to the cap portion of the weight receptacle. The slug is an elongate member and includes a retention portion and an extension portion, and at least a portion of the retention portion is disposed in the recess of the cap. The extension portion includes a tapered portion that is at least partially disposed in the seat portion of the weight receptacle when the weight is installed in the weight receptacle. The weight receptacle is at least partially constructed from a receptacle component that is formed separate from the body and coupled to the body. The receptacle component is constructed of a material that is different than a material of the body, and the receptacle component is bonded to the body.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

The present invention is directed to a golf club head and a removable weight. The removable weight is provided for use with a golf club head to alter the mass properties of the golf club head. Several embodiments of the present invention are described below.

Figure 1:
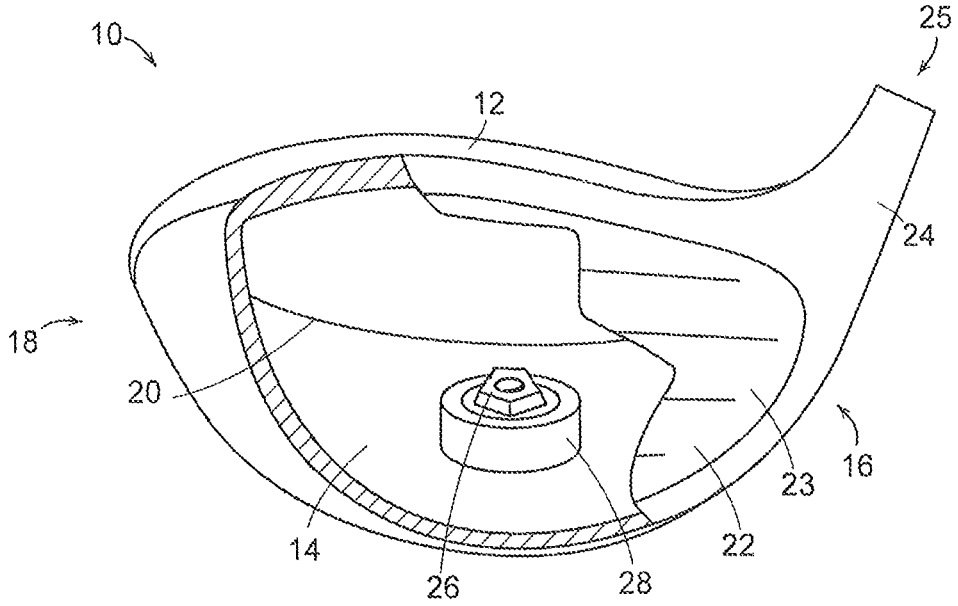
FIG. 1 is a front view of a portion of a golf club head including a weight in accordance with the present invention.
Figure 2:
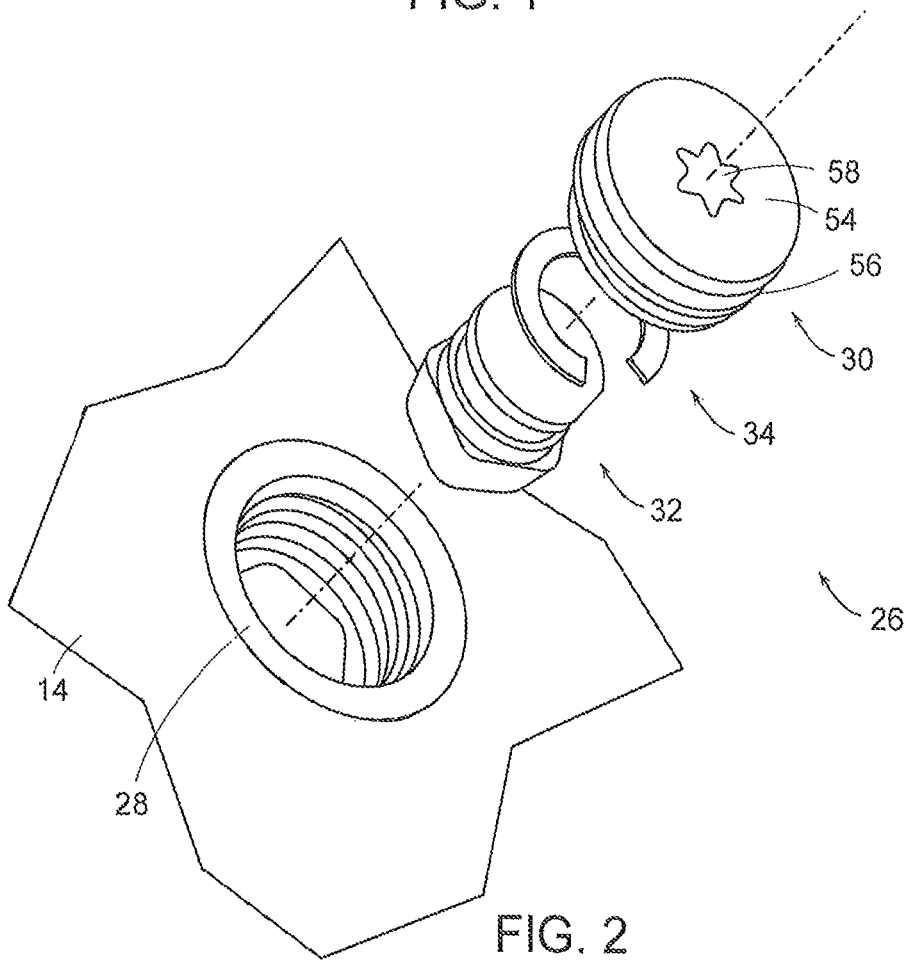
FIG. 2 is an exploded view of a portion of the golf club head of FIG. 1.

Referring to FIGS. 1 and 2 a golf club head including an embodiment of a weight in accordance with the present invention will be described. Golf club head 10 generally includes a crown portion 12, a sole portion 14, a heel portion 16, a toe portion 18, a rear portion 20, a front portion 22, a hosel 24 and a weight 26. Front portion 22 includes a striking face 23 for impacting a golf ball. Crown portion 12 extends rearward from front portion 22 and forms a top surface of club head 10. Heel portion 16, toe portion 18 and rear portion 20 combine to form side walls of club head 10 and extend generally downward from the peripheral edge of crown portion 12 to the peripheral edge of sole portion 14. Sole portion 14 extends between the lower edges of front portion 22, heel portion 16, toe portion 18 and rear portion 20.

Hosel 24 is a generally tubular member that extends outward from crown portion 12 generally adjacent the intersection of heel portion 16 and front portion 22. In a complete golf club incorporating golf club head 10, a golf club shaft is attached to golf club 10 at hosel 24. For example, an end of the shaft is received in a shaft bore 25 defined by hosel 24 and bonded to hosel 24. It should be appreciated that hosel 24 is one exemplary construction, but any hosel construction may be incorporated into club head 10.

Weight receptacle 28 is included in one of the components of club head 10 and receives weight 26. In the present embodiment, club head 10 includes a single weight receptacle 28 provided in sole portion 14. However, it should be appreciated that any number of weight receptacles may be provided in the club head and each weight receptacle 28 may have any location and orientation corresponding to any desired design attribute. For example, a plurality of weight receptacles 28 may be provided in club head 10 to allow alteration of the location of the center of gravity of club head 10. The center of gravity may be relocated in a heel to toe direction to impart draw bias or fade bias and/or in a front to rear direction to alter launch angle and spin characteristics. The weight receptacle may be constructed as an integral part of club head 10 or it may be constructed as a separate component and attached to club head 10. Additionally, in embodiments utilizing a separate receptacle component, the receptacle may be constructed as a full receptacle including both a cap portion and a seat portion, or a partial receptacle including either a cap portion or a seat portion. Furthermore, in a club head constructed from cast components, a full weight receptacle may be cast integral with the corresponding club head component.

Figure 3A:
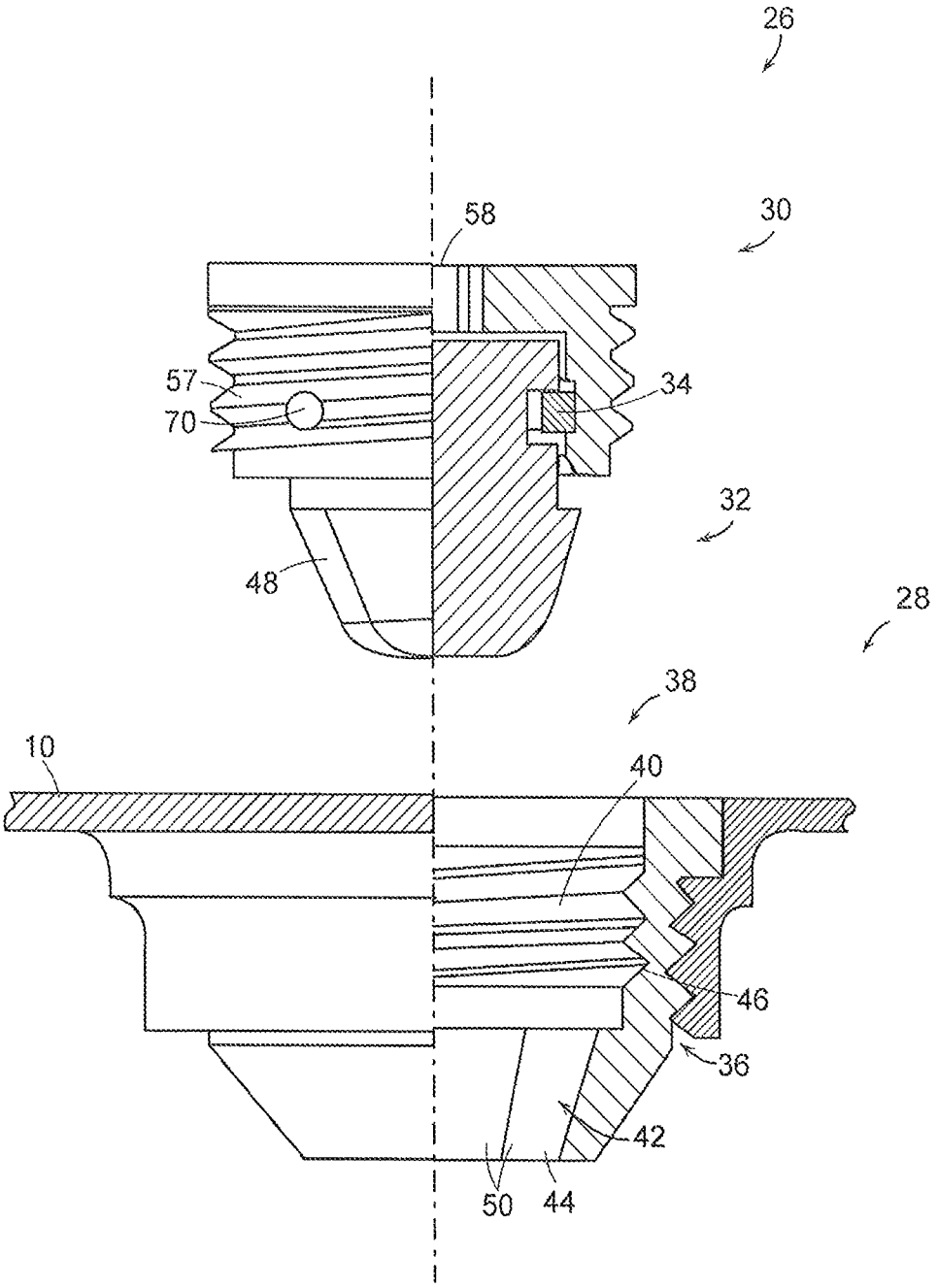
FIGS. 3A-3D are partial cross-sectional views of embodiments of a weight and a weight receptacle in a club head in accordance with the present invention.

Embodiments of full and partial weight receptacles constructed as separate components are illustrated in FIGS. 3A-3D. Referring first to FIG. 3A, weight receptacle 28 is a full receptacle that is a generally tubular or cup-shaped component that is sized and shaped to receive weight 26. In the present embodiment, weight receptacle 28 includes an outer attachment feature 36 that is used to permanently or semi-permanently attach weight receptacle 28 to a portion of club head 10. Outer attachment feature 36 may include a threaded surface, a bonding surface and/or a welding surface. As shown, weight receptacle 28 includes outer attachment feature 36, which is a threaded outer surface that is configured to engage a threaded hole included in club head 10.

Receptacle 28 includes a bore 38 that extends through a cap portion 40 and a seat portion 42. Cap portion 40 is configured to receive and to be removably attached to a cap 30 included in weight 26. An inner attachment feature 46 is included in cap portion 40 that allows cap 30 to be removably coupled to receptacle. In the present embodiment, inner attachment feature 46 is a threaded surface that engages a threaded outer surface 57 of cap 30.

Seat portion 42 of receptacle 28 is sized and shaped to receive a portion of a slug 32 that is included in weight 26. Slug portion 42 of receptacle includes an anti-rotation feature 44 that cooperates with a complementary anti-rotation feature 48 of slug 32 to prevent relative rotation between slug 32 and receptacle 28 when slug 32 is received therein. In the present embodiment, seat portion 42 includes a plurality of tapered facets 50 combined so that seat portion 42 is generally tubular and tapered and has a generally polygonal cross-sectional shape. However, it should be appreciated that the length of seat portion 42 may be reduced so that rather than including a plurality of facets seat portion 42 merely includes a polygonal opening sized to abut slug 32.

Figure 3B:
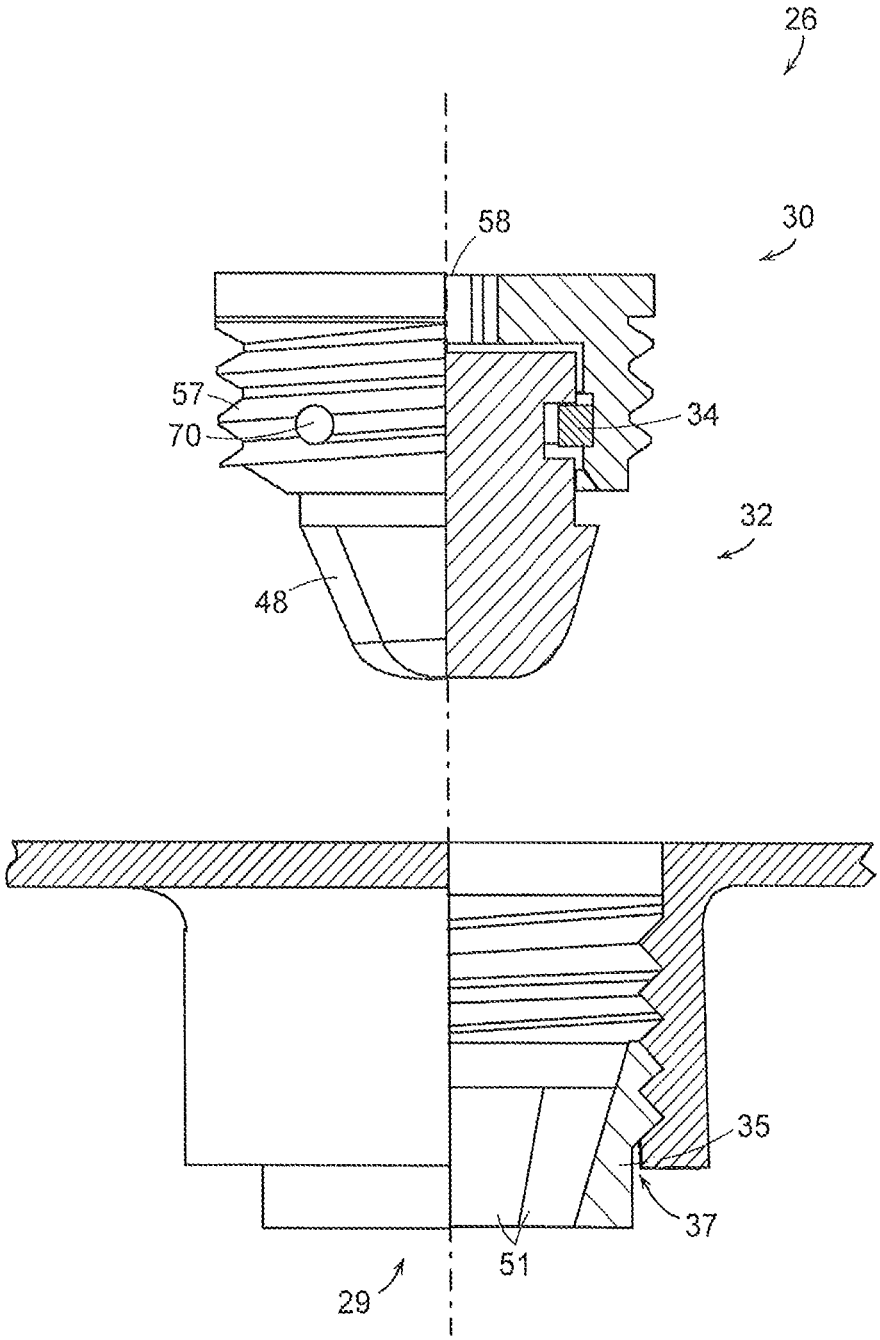

In another embodiment, illustrated in FIG. 3B, a partial weight receptacle 29 includes only a seat portion 35. Seat portion 35 includes an outer attachment feature 37 and a plurality of facets 51. In the present embodiment, outer attachment feature 37 is a threaded outer surface that engages a threaded bore in a club head. Weight receptacle 29 is configured to be threaded into the club head through the outer end of the threaded bore and the threaded bore is preferably threaded only along a portion of its length so that receptacle 29 is prevented from threading past an inner end of the threaded bore and becoming disengaged. The threaded bore of the club head is sized to engage the threaded outer surface of cap 30 of weight 26. As a result, when weight 26 is installed in the club head, cap 30 is coupled to the threaded bore and slug 32 is coupled to receptacle 29. A tool may be used to rotate weight receptacle 29 relative to the club head by engaging facets 51 of seat portion 35 or a separate tool engagement feature may be provided.

Figure 3C:
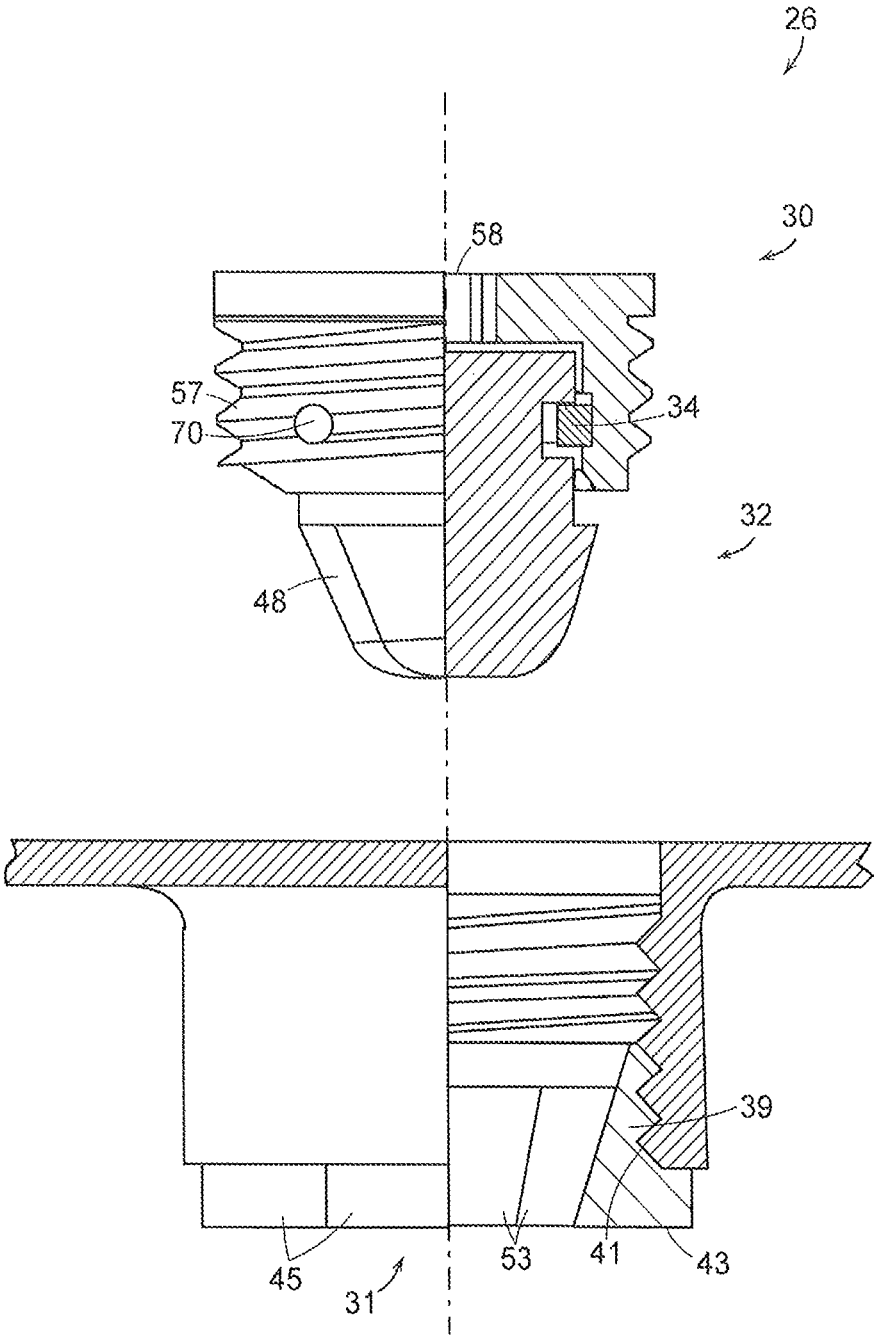

Another partial weight receptacle 31 includes only a seat portion 39, as shown in FIG. 3C. Seat portion 39 includes an outer attachment feature 41, a plurality of facets 53 and a travel limit flange 43. Outer attachment feature 41 is a threaded outer surface that engages a threaded bore in a club head. Weight receptacle 31 is configured to be threaded into the club head through the inner end of the threaded bore and flange 43 limits the engagement of weight receptacle 31 in the threaded bore. During manufacture, weight receptacle 31 would be installed in the club head prior to the complete assembly of the club head shell. For example, weight receptacle 31 would be installed in the club head prior to attachment of a separate face insert or a separate crown or sole piece. The threaded bore of the club head is sized to engage the threaded outer surface of cap 30 of weight 26. As a result, when weight 26 is installed in the club head, cap 30 is coupled to the threaded bore and slug 32 is coupled to receptacle 31. An optional tool engagement feature 45 may be included on weight receptacle 31 so that it may be threaded into the threaded bore. Tool engagement feature may be a plurality of facets disposed on flange 43 so that flange 43 is hexagonally shaped and sized to mate with a wrench, such as a socket wrench.

Figure 3D:
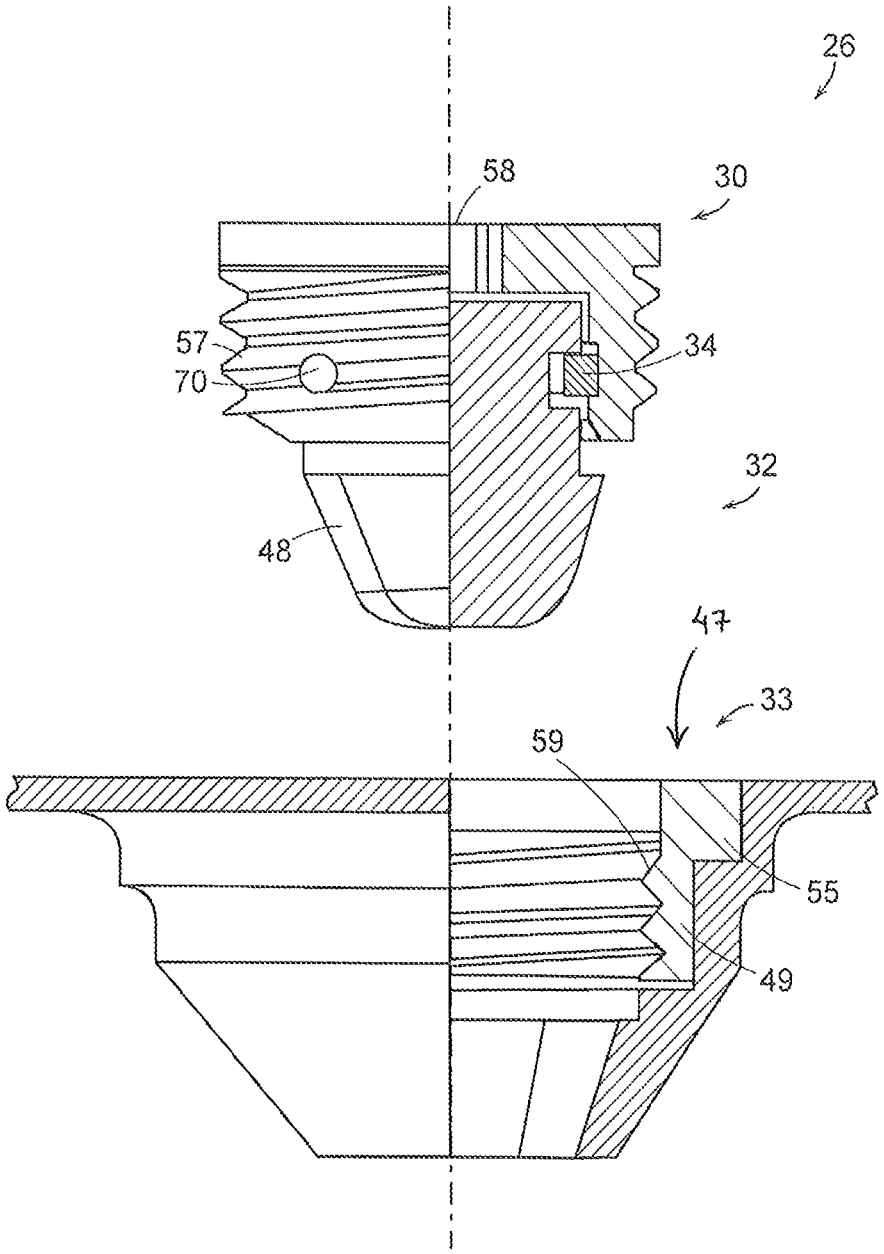

In a still further embodiment, a partial weight receptacle 33 includes only cap portion 47, as shown in FIG. 3D. Cap portion 47 includes a generally tubular cylindrical body member 49 and a travel limit flange 55. Receptacle 33 is inserted into a bore included in a club head and attached thereto. For example, receptacle 33 may be bonded, welded and/or staked, such as by dowel pins. Receptacle 33 includes a threaded inner surface 59 that is sized to engage the threaded outer surface of cap 30 of weight 26. In the present embodiment, the club head includes a seat portion including an anti-rotation feature that is preferably integrally cast with the remainder of the club head.

In embodiments utilizing a separate weight receptacle, the receptacle may be constructed from any metallic or non-metallic material. For example, the weight receptacle may be constructed of titanium, steel, aluminum, tungsten, and/or any alloys of those materials. Including a separate weight receptacle permits the use of materials different than the club head that may be selected to simplify manufacturing of the receptacle.

Referring back to FIG. 3A, weight 26 is assembled from a cap 30 and a weight slug 32 that are movably attached by retainer 34. Cap 30 and slug 32 are coupled so that they are able to rotate relative to each other about the longitudinal axis of weight 26. When weight 26 is installed in club head 10, cap 30 engages the cap portion of the receptacle and retains slug 32 within receptacle 28. Cap 30 also provides a cover for slug 32 so that when installed in golf club head 10 weight 26 has a desired appearance to a user regardless of the configuration of slug 32.

Figure 4:
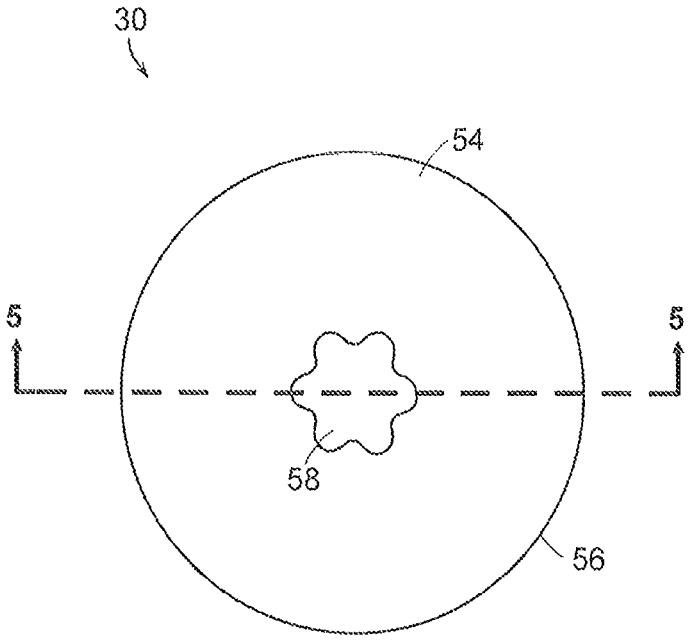
FIG. 4 is a side view of an embodiment of a cap that is included in the weight of FIGS. 3A-3D.
Figure 5:
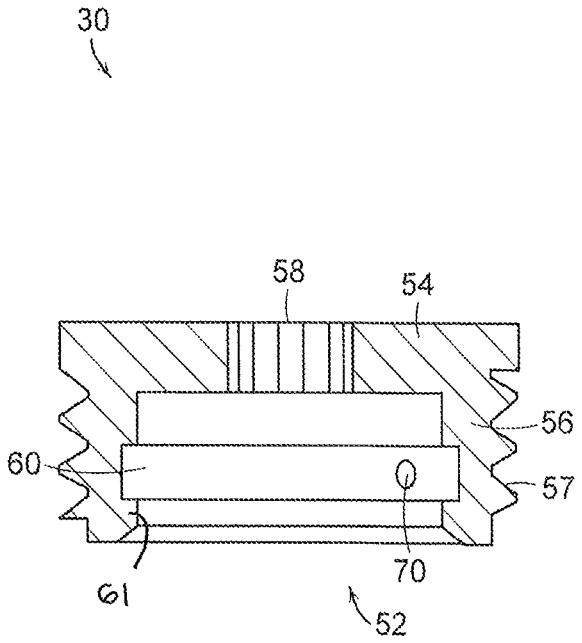
FIG. 5 is a cross-sectional view of the cap of FIG. 4.

Cap 30 is a cup-shaped member formed from a base 54 and side wall 56 that define a recess 52, as shown in FIGS. 3-5. Recess 52 receives at least a portion of slug 32 when weight 26 is installed in club head 10. Side wall 56 is a generally annular wall that extends away from base 54. Side wall 56 of cap 30 includes threaded outer surface 57 to mate with the threaded inner attachment feature 46 of receptacle 28. The length and diameter of side wall 56 are selected so that recess 52 may receive a portion of slug 32. Additionally, a retention feature 60 may be included in cap 30 so that slug 32 may be movably coupled to cap 30 so that relative rotation between cap 30 and slug 32 is permitted while relative translation is prevented in the assembled weight 26 to avoid disengagement. In the present embodiment, retention feature 60 is a circumferential channel that extends into side wall 56 from the inner surface of side wall 56 and defines a retention flange 61 at an end of side wall 56 opposite base 54. It should be appreciated that the height of the channel may be as small as approximately equal to the height of retainer 34, as shown in FIG. 3, or as large as the distance from retention flange 61 to the surface of base 54 that forms the end of recess 52.

A tool engagement feature 58 is included in base 54 of cap 30. The tool engagement feature is a feature that mates with a tool manipulated by a user so that weight 26 may be installed or removed from receptacle 28. Tool engagement feature 58 is shaped and sized to mate with a complementary tool. For example, tool engagement feature 58 may be configured to receive a Torx-type wrench (as shown), a screw driver, a spanner wrench or any other standard or custom tool. Preferably, tool engagement feature 58 is configured to mate with a tool other than articles that are commonly carried by a golfer during a round of golf (e.g., coins, divot tools and golf tees).

Figure 6:
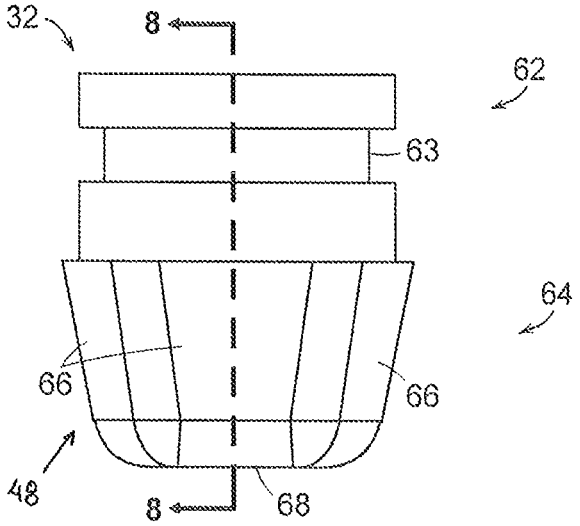
FIG. 6 is a side view of an embodiment of a weight slug that is included in the weight of FIGS. 3A-3D.
Figure 7:
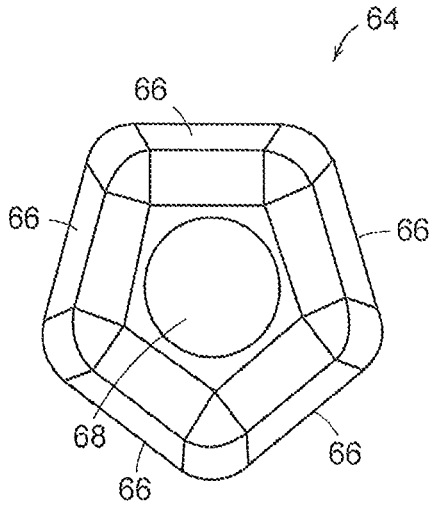
FIG. 7 is another side view of the weight slug of FIG. 6.
Figure 8:
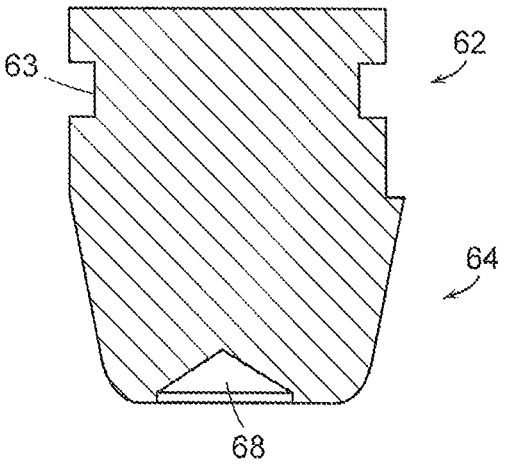
FIG. 8 is a cross-sectional view of the weight slug of FIG. 6.

Slug 32 is a mass member that is movably coupled to cap 30 in weight 26. Slug 32 is a generally elongate member that includes a retention portion 62 movably coupled to cap 30 and an extension portion 64 that includes anti-rotation feature 48, as shown in FIGS. 6-8. Retention portion 62 is a generally cylindrical portion of slug 32 that has an outer diameter that is less than the inner diameter of side wall 56 so that at least a portion of retention portion 62 is received within recess 56. Preferably, retention feature 60 of cap 30, retention portion 62 of slug 32 and retainer 34 are dimensioned so that when weight is installed in receptacle 28 retention portion 62 and base 54 of cap 30 are in forced abutment so slug 32 is pressed into receptacle 28.

A retention feature 63 is included in retention portion 62 of slug 32 that allows slug 32 to be movably coupled to cap 30. In the present embodiment, retention feature 63 is a circumferential channel that extends into slug 32 from an outer surface of retention portion 62. In the assembled weight, a retainer 34 extends from cap 30 and into retention feature 63 and limits relative translation between slug 32 and cap 30 in the direction of the longitudinal axis of weight 26 so that slug 32 is prevented from fully disengaging from cap 30.

Extension portion 64 of slug 32 engages seat portion 42 of receptacle so that relative rotation between receptacle 28 and slug 32 is prevented when weight 26 is installed. In particular, extension portion 64 of slug 32 includes anti-rotation feature 48 that is generally tapered and has a polygonal cross-sectional shape formed by a plurality of tapered facets 66 that complement facets 50 of seat portion 42 of receptacle 28. For example, portion 64 of slug 32 includes a plurality of tapered facets so that the cross-sectional shape of portion 64 is pentagonal and complements the pentagonal cross-sectional shape of seat portion 42 of receptacle 28. It should be appreciated that although seat portion 42 of receptacle 28 is tapered, it should be appreciated that seat portion 42 need not be tapered, but instead may have constant cross-sectional shape and size that correspond to the shape and size of an intermediate location along extension 64.

The dimensions and material of slug 32 are selected to provide any desired mass for weight 26. Mass adjustment features 68 may be included in slug 32 to fine tune the mass of the member. For example, slug 32 includes a mass adjustment feature 68 that is a bore extending into slug 32 from an end of portion 64 opposite retention portion 62. It should be appreciated that the bore may be any depth so that any desired amount of material is removed to reduce the mass of slug 32. Additionally, although the bore is shown extending through slug 32 generally coaxial with the longitudinal axis of slug 32, it should be appreciated that the bore may have any desired orientation and multiple mass adjustment features may be included.

Figure 9:
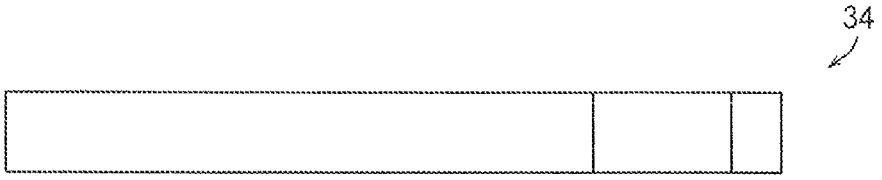
FIG. 9 is a side view of an embodiment of a retainer that is included in the weight of FIG. 3.
Figure 10:
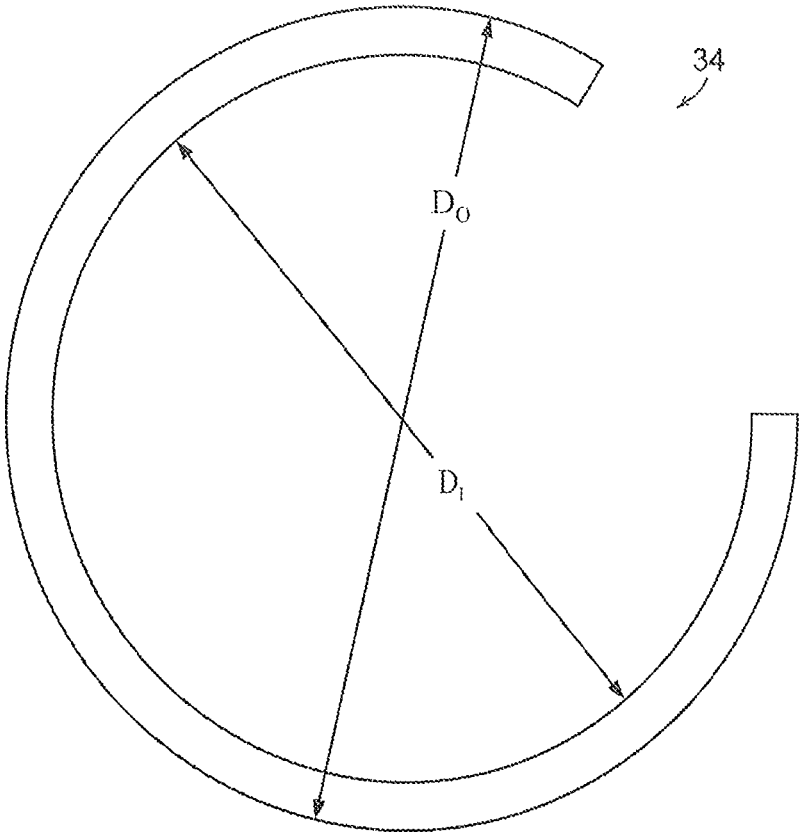
FIG. 10 is another side view of the retainer of FIG. 9.

Referring to FIGS. 9 and 10, retainer 34 included in the assembled weight 26 will be described. Retainer 34 is a spring clip in the form of a flexible, semi-circular annular member that is constructed so that it is capable of being elastically deformed between a first configuration and a second configuration. In the first configuration, retainer 34 has a first inner diameter $D_I$ that is approximately equal to the minimum diameter of the channel that forms retention feature 63 of slug 32 and a first outer diameter $D_O$ that is less than the inner diameter of side wall 56 of cap 30, and preferably approximately equal to the outer diameter of retention portion 62 of slug 32. In the second configuration, retainer has a second inner diameter $D_I$ that is less than the outer diameter of retention portion 62 of slug 32 and a second outer diameter $D_O$ that is greater than the inner diameter of wall 56 of cap 30.

In the assembled weight 26, retainer 34 is in the second configuration and is interposed between cap 30 and slug 32 and extends across a sliding interface between cap 30 and slug 32. During assembly, however, retainer 34 is deformed from the second configuration into the first configuration and is disposed within retention feature 63 so that it and retention portion 62 of slug 32 may be inserted into recess 56. Because retainer 34 is elastically deformed from the second configuration into the first configuration, when slug 32 and cap 30 are positioned so that retention features 60 and 63 align, retainer 34 springs back to the second configuration and extends across the interface between cap 30 and slug 32 to prevent relative translation therebetween. Cap 30 may also include one or more optional access bores 70 that extend generally radially through side wall 56 and intersect retention feature 60 so that weight 26 may be disassembled. For example, a plurality of rods may be inserted through bores 70 and pressed against the outer wall of retainer 34 so that retainer 34 may be deformed from the second configuration into the first configuration in the assembled weight 26. Deforming retainer 34 into the first configuration allows slug 32 to be separated from cap 30.

Cap 30, slug 32 and retainer 34 may be constructed from any desired materials to provide any desired weights. In an embodiment, cap 30 is constructed of aluminum, slug 32 is constructed of steel and retainer 34 is constructed of stainless steel and weight 26 has a total weight of approximately 8.3 grams. In another embodiment, cap 30 is constructed of aluminum, slug 32 is constructed of a tungsten alloy and retainer 34 is constructed of stainless steel and weight 26 has a total weight of approximately 13.1 grams. In these exemplary embodiments, the density of the material used to construct slug 32 is greater than the material used to construct cap 30, but it should be appreciated that the cap and slug may be constructed from the same material or the slug may be constructed from a material having a density that is less than the density of a material used to construct the cap.

As described above, the weight slug includes an extension and an anti-rotation feature that is configured to complement a seat portion of the receptacle. For example, slug 32 includes extension portion 64 that has a generally pentagonal cross-sectional shape. Additional embodiments of an extension portion of the slug that also provide an anti-rotation feature are illustrated in FIGS. 11-14.

Figure 11:
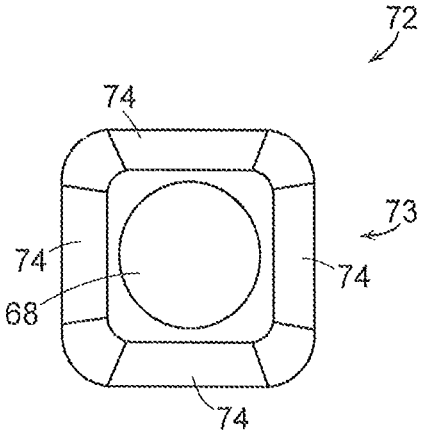
FIG. 11 is a side view of another embodiment of a weight slug.
Figure 12:
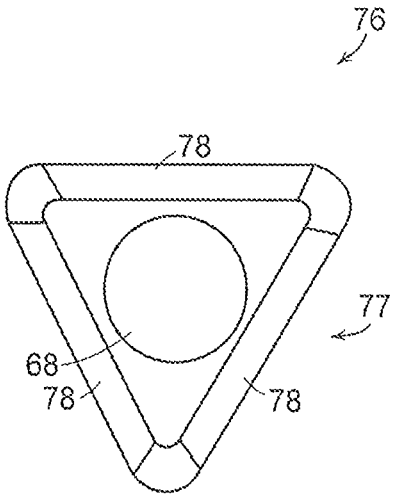
FIG. 12 is a side view of a further embodiment of a weight slug.
Figure 13:
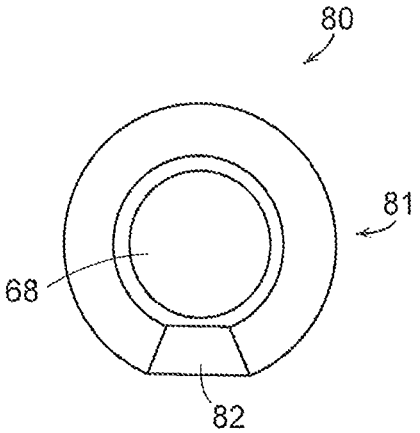
FIG. 13 is a side view of a still further embodiment of a weight slug.
Figure 14:
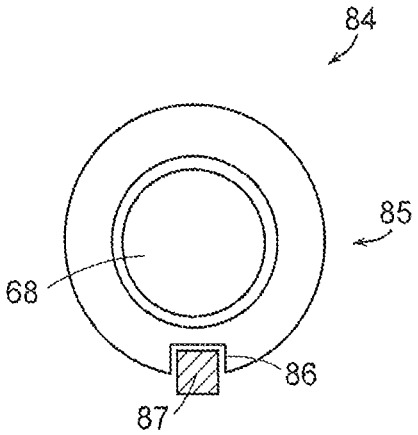
FIG. 14 is a side view of another embodiment of a weight slug that includes a separate anti-rotation member.

Referring first to FIG. 11, slug 72 includes an extension 73 that is tapered and has a square cross-sectional shape so that it defines a plurality of tapered facets 74. In another embodiment, shown in FIG. 12, a slug 76 includes an extension 77 that is tapered and has a triangular cross-sectional shape so that it defines three tapered facets 78. In another embodiment, illustrated in FIG. 13, slug 80 includes an extension 81 that is generally shaped as a truncated cone. Slug 80 further includes a single facet 82 that acts as an anti-rotation feature when mated with the seat portion of a receptacle having a complementary cross-sectional shape. Referring to FIG. 14, slug 84 includes an extension 85 that is also shaped as a truncated cone, but instead of a facet, extension 85 includes keyway 86 that is sized and shaped to receive a separate anti-rotation member 87. In such an embodiment, the receptacle also includes a channel that aligns with keyway 86 to allow insertion of anti-rotation member 87. Although each of the previously described embodiments is illustrated with mass adjustment feature 68, it should be appreciated that the feature may be omitted if desired. It should further be appreciated that the seat portions of corresponding receptacles may be tapered or straight-walled.

Figure 15:
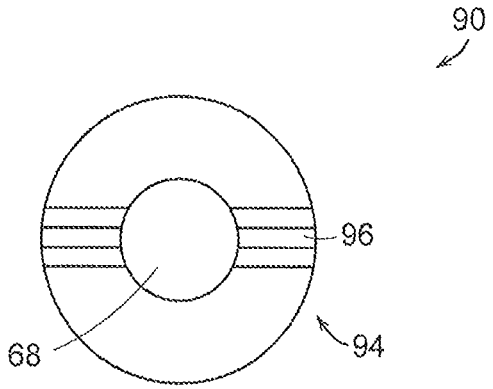
FIG. 15 is a side view of another embodiment of a weight slug.
Figure 16:
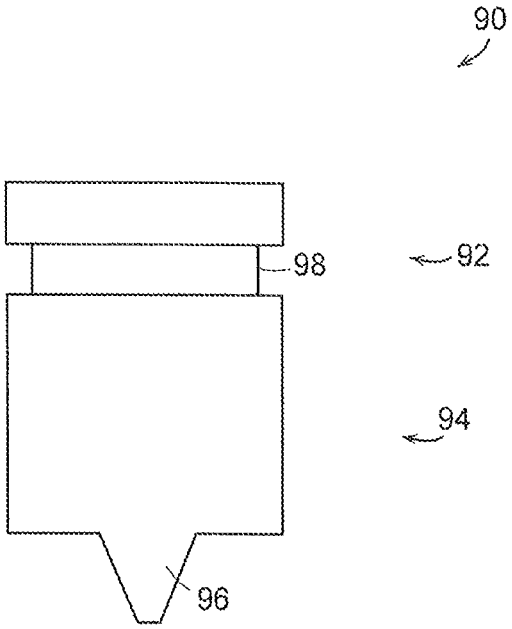
FIG. 16 is another side view of the weight slug of FIG. 15.

Referring to FIGS. 15 and 16, another embodiment of the weight slug will be described. Slug 90 is a mass member that is configured to be movably coupled to a cap of a weight assembly, such as cap 30 of weight 26. Slug 90 includes retention portion 92 and extension portion 94. Similar to the previously described embodiments, retention portion 92 is configured to be removably coupled to a cap, and includes a retention feature 98 that is a channel configured to receive a portion of a retainer.

Extension portion 94 is a generally cylindrical portion that includes an anti-rotation feature 96. In the present embodiment, anti-rotation feature 96 is a tapered rib that extends diametrically across an end of extension portion 94. It should be appreciated that anti-rotation feature 96 is configured to engage a diametric slot included in a corresponding receptacle. For example, a slot having a width that is between the maximum and minimum widths of the tapered rib may be provided or a tapered slot may be provided. Furthermore, slug 90 includes an optional mass adjustment feature 68 that is a bore extending into slug 90 from an end of extension portion 94 opposite retention portion 92.

Figure 17:
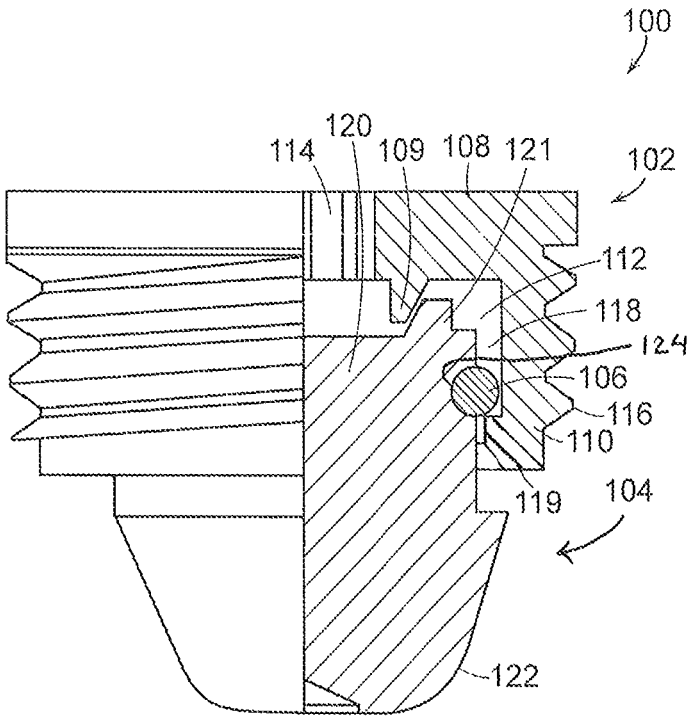
FIG. 17 is a partial cross-sectional view of another embodiment of a weight in accordance with the present invention.
Figure 18:
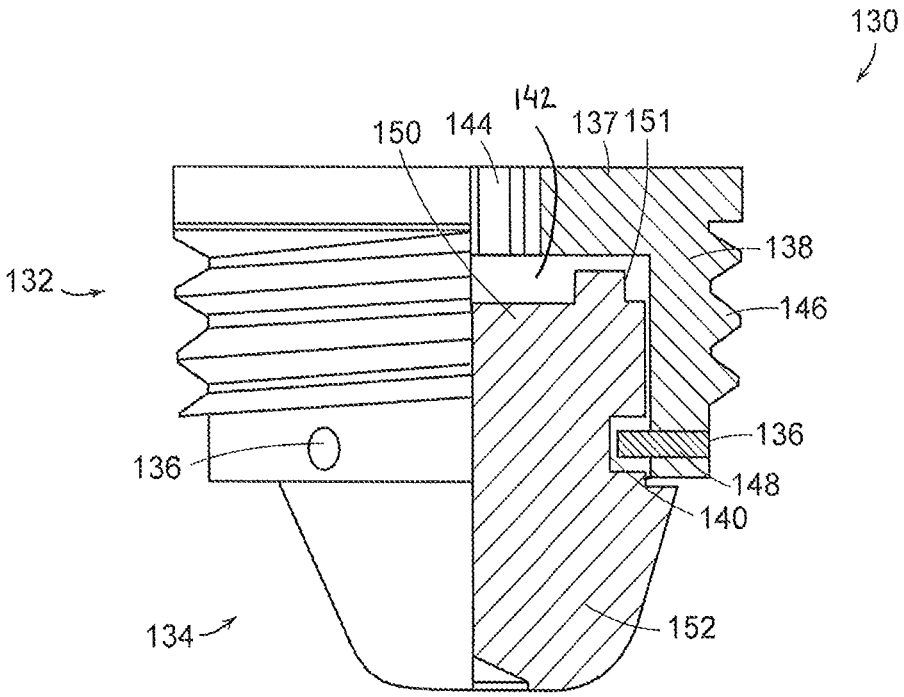
FIG. 18 is a partial cross-sectional view of another embodiment of a weight.

The retainer used to movably couple the cap and slug may have any configuration that allows relative rotation between the cap and slug while preventing the slug from becoming fully disengaged from a recess provided in the cap. Other embodiments of the assembled weight including different retainers are illustrated in FIGS. 17 and 18. Referring first to FIG. 17, weight 100 includes a cap 102, a slug 104 and a retainer 106. Retainer 106 of weight 100 is a deformable ring that is a complete circular annulus constructed from a deformable material and that extends across a sliding interface between cap 102 and slug 104. Cap 102 includes a base 108 and side wall 110 that extends from base 108 to define a recess 112. Base 108 includes a tool engagement feature 114 that allows weight 100 to be installed in or removed from a corresponding receptacle. Side wall 110 includes an attachment feature, such as a threaded outer surface 116, for coupling cap 102 to a receptacle, and a retention feature 118 for movably coupling cap 102 and slug 104.

Retention feature 118 is a channel that has a height that is approximately as large as the distance from a retention flange 119 to the surface of base 108 that forms the end of recess 112. As a result, when weight 100 is installed in a corresponding receptacle, a retention portion 120 of slug 104 is pressed against base 108 of cap 102. To reduce the surface area contact between retention portion 120 of slug 104 and base 108 of cap 102, bearing features may be included on the respective components. In particular, a projection 109 extends from base 108 toward retention portion 120 and a complementary projection 121 extends from retention portion toward base 108. Projections 109 and 121 are preferably annular and include tapered contact surfaces that abut and slide against each other as weight 100 is installed in a receptacle. Projections may be included on one or both of the cap and slug to provide a reduced contact surface area. Alternatively, a separate bearing feature may be included to reduce the contact surface area, such as a rigid or compressible annular ring interposed between base 108 and retention portion 120.

Slug 104 includes retention portion 120 and extension portion 122. Retention portion 120 extends into recess 112 of cap 102 and is used to retain slug 104 with cap 102 so that the components are free to rotate relative to each other while preventing full disengagement of slug 104 from cap 102. As described in previous embodiments, extension portion 122 extends from retention portion 120 and engages a seat portion of a corresponding receptacle when weight 100 is installed in a club head. The configuration of extension portion 122 is substantially identical to those previously described.

Retention portion 120 includes a retention feature 124 that receives a portion of deformable retainer 106 so that retainer 106 is held in place on slug 104. For example, retention feature 124 of the present embodiment is a circumferential channel that extends generally radially into slug 104 from an outer surface of retention portion 120.

Weight 100 is assembled by installing retainer 106 in retention feature 124. Then retention portion 120 and retainer 106 are inserted into recess 112. When retainer 106 is pressed against retention flange 119, it is forced to deform. The inner dimension of retention flange 119 is selected so that it is greater than a deformed outer dimension of retainer 106, but smaller than the free outer dimension of retainer 106 so that as retainer 106 deforms it is able to slide past retention flange 119 and into retention feature 118. After the deformed retainer 106 passes by retention flange 119, it is free to deform back to the free outer dimension. Because the inner dimension of retention flange 119 is smaller than the free outer dimension of retainer 106, retention portion 120 of slug 104 is retained in recess 112 of cap 102.

Another embodiment of the weight is illustrated in FIG. 18. Weight 130 includes a cap 132, a slug 134 and a retainer 136. In the present embodiment, retainer 136 is a member that extends through a side wall 138 of cap 132, across the interface between cap 132 and slug 134, and into a retention feature 140 of slug 134.

Similar to previous embodiments, cap 132 includes a base 137 and side wall 138 that extends from base 137 to define a recess 142. Base 137 includes a tool engagement feature 144 that allows weight 130 to be installed in or removed from a corresponding receptacle. Side wall 138 includes an attachment feature, such as a threaded outer surface 146, for coupling cap to a receptacle, and a retention feature 148 for movably coupling cap 132 and slug 134. In the present embodiment, a single annular projection 151 is incorporated that extends from retention portion 150 toward base 137 of cap 132 to reduce contact surface area between retention portion 150 and base 137.

Retention feature 148 is a bore that extends through side wall 138. Retention feature 148 is sized and shaped to receive retainer 136, which is an elongate member such as a dowel pin or set screw. The length of retainer 136 is selected so that it extends through side wall 138 and into retention feature 140 of slug. The size and shape of retention feature 148 is selected according to the configuration of retainer 136. For example, in embodiments utilizing a dowel pin as retainer 136, the diameter of retention feature 148 is selected so that the dowel pin is captured in retention feature 148 by a press, or interference fit. In other embodiments utilizing a set screw as retainer 136, retention feature 148 is a threaded bore sized to threadably engage the set screw. It should be appreciated that any number of retainers 136 may be included that extend through side wall 138. Additionally, it should be appreciated that retention feature 148 may be configured so that retainer 136 extends through side wall radially or at any angle. For example, retention feature 148 may be configured so retainer 136 extends toward slug 134 approximately normal to retention feature 140 of slug 134. In another example, retention feature 148 may be configured so retainer 136 extends toward slug 134 so that it is approximately tangent to retention feature 140 of slug 134.

Slug 134 includes retention portion 150 and extension portion 152. Retention portion 150 extends into recess 142 of cap 132 and is used to retain slug 134 with cap 132 so that the components are free to rotate relative to each other while preventing full disengagement of slug 134 from cap 132. As described in previous embodiments, extension portion 152 extends from retention portion 150 and engages a seat portion of a corresponding receptacle when weight 130 is installed in a club head. The configuration of extension portion 152 is substantially identical to those previously described.

Retention portion 150 includes a retention feature 140 that receives a portion of retainer 136 in the assembled weight 130. Retention feature 140 of the present embodiment is a circumferential channel that extends generally radially into slug 134 from an outer surface of retention portion 150.

Weight 130 is assembled by inserting retention portion 150 of slug 134 into recess 142 of cap 132. Retention portion 150 is inserted to a position in which retention feature 140 of slug 134 is aligned with retention feature 148 of cap 132. Retainer 136 is then inserted through retention feature 148 and into retention feature 140.

Figure 19:
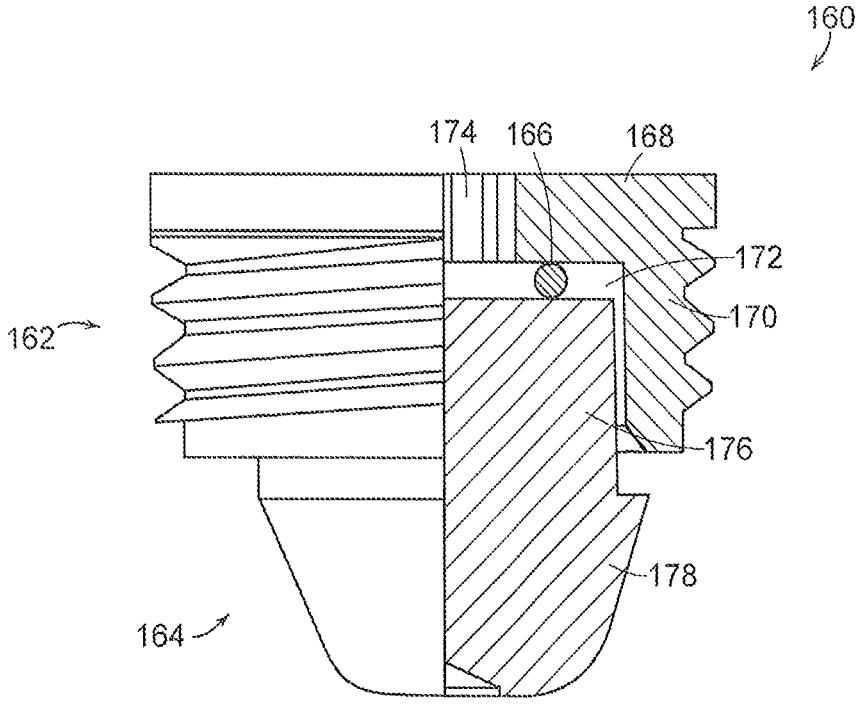
FIG. 19 is a partial cross-sectional view of a further embodiment of a weight.

In another embodiment, shown in FIG. 19, weight 160 includes cap 162, slug 164 and compression member 166. Cap 162 includes a base 168 and side wall 170 that extends from base 168 to define a recess 172. Base 168 includes a tool engagement feature 174 that allows weight 160 to be installed in or removed from a corresponding receptacle.

Slug 164 includes retention portion 176 and extension portion 178. Retention portion 176 extends into recess 172 of cap 162 and retains slug 164 in coaxial alignment with cap 162 during installation into a corresponding receptacle. Retention portion 176 is configured so that the components are free to rotate relative to each other during installation. As described in previous embodiments, extension portion 178 extends from retention portion 176 and engages a seat portion of a corresponding receptacle when weight 160 is installed in a club head. The configuration of extension portion 178 is substantially identical to those previously described.

Compression member 166 is included in weight 160 and disposed between base 168 of cap 162 and retention portion 176 of slug 164. Compression member 166 is an elastic member that is compressed when weight 160 is installed in a receptacle so that extension portion 178 of slug 164 is pressed into a seat portion of the receptacle. Compression member 166 may have any desired shape, for example, compression member 166 may be disk-shaped or annular, as shown in FIG. 19.

Weight 160 is assembled by inserting compression member 166 into recess 172 of cap 162 and then inserting retention portion 176 of slug 164. The weight 160 is then inserted into a receptacle and cap 162 is engaged with a cap portion of the receptacle until compression member 166 is compressed a desired amount to place a selected preload on slug 164.

Figure 20:
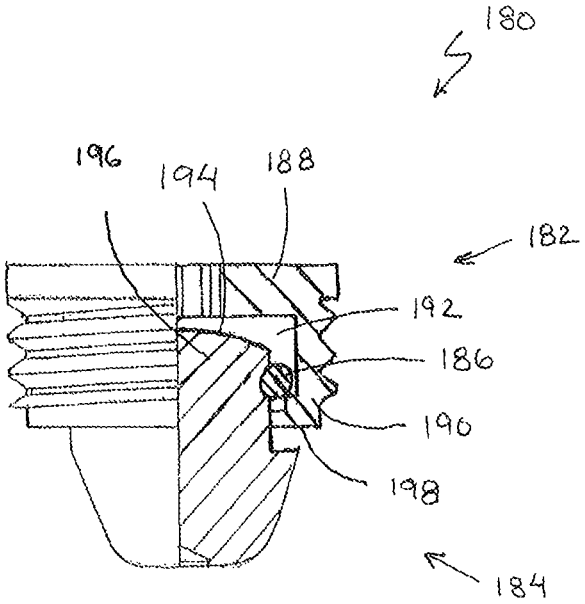
FIG. 20 is a partial cross-sectional view of another embodiment of a weight.
Figure 21:
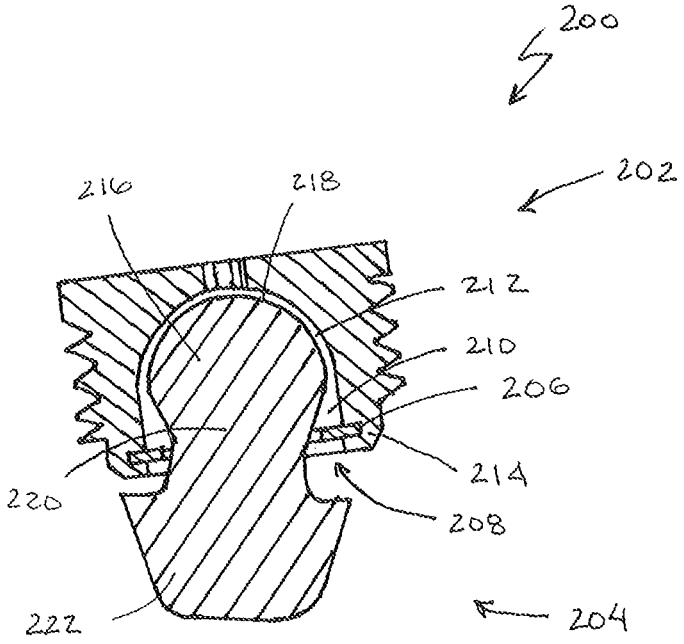
FIG. 21 is a cross-sectional view of another embodiment of a weight.
Figure 22:
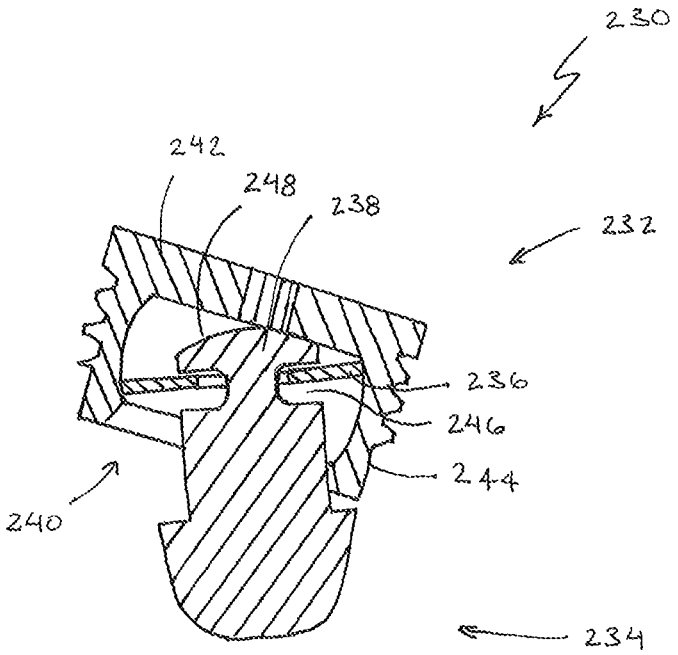
FIG. 22 is a cross-sectional view of yet another embodiment of a weight.

The weight may also be configured to provide additional compensation for misalignment of the components resulting from manufacturing tolerances as shown in the embodiments of FIGS. 20-22. It should be appreciated that the common features previously described will not be further described. Referring to FIG. 20, weight 180 includes a cap 182, a slug 184 and a retainer 186. Retainer 186 is a deformable ring that is an annular member constructed of a deformable material. Retainer 186 extends across an interface between slug 184 and a side wall 190 of cap 182. Side wall 190 extends from a base 188 of cap to define a recess 192 that receives a retention portion 196 of slug 184. Side wall 190 also includes an annular retention flange 198 that extends radially inward and has an inner diameter that is smaller than the free outer diameter of retainer 186 when retainer 186 is installed on slug 184 and retention portion 196 is received in recess 192. The configuration of retainer 186 is similar to the configuration of weight 100 of FIG. 17 and the method of assembling weight 180 is generally identical to that of weight 100.

When the assembled weight 180 is installed in a corresponding receptacle, retention portion 196 of slug 184 is pressed against base 188 of cap 182. In some instances, due to manufacturing tolerances in weight 180 and the receptacle, cap 182 is not coaxially aligned with slug 184 when installed. In order to assure contact between cap 182 and slug 184 with such misalignment, an abutment surface 194 of retention portion 196, i.e., the surface of retention portion 196 that abuts base 188, is curved. Abutment surface 194 may have any curvature, for example, abutment surface 194 may be parabolic or spherical.

The configuration of the cap, the retainer, and the retention portion of the slug may be selected to provide additional freedom for the cap and the slug to be misaligned. Referring to FIG. 21, weight 200 includes a cap 202, a slug 204 and a retainer 206. In the present embodiment, retainer 206 is a spring clip in the form of a flexible, semi-circular annular member. Cap 202 defines a recess 208 that includes a first generally cylindrical portion 210 and a second generally spherical portion 212. A circumferential channel 214 extending into the side wall of the cylindrical portion 210 of recess 208 receives a portion of retainer 206 so that when retainer 206 is received therein, another portion of retainer 206 extends radially inward from the side wall of portion 210.

Recess 208 receives a retention portion 216 of slug 204. Retention portion 216 includes a spherical abutment surface 218 that abuts spherical portion 212 of recess 208. A neck portion 220 extends between abutment surface 218 of retention portion 216 and extension portion 222. Neck portion 220 is a section of retention portion 216 that includes an outer diameter that is smaller than the outer diameter of the part of retention portion 216 including abutment surface 218.

Channel 214 is located in cap 202 so that in the assembled weight 200, retainer 206 is positioned adjacent neck portion 220. Additionally, retainer 206 is sized so that the inner diameter of retainer 206 is smaller than the greatest outer diameter of retention portion 216 so that retainer 206 prevents disengagement of slug 204 from cap 202. Furthermore, retainer 206 is sized so that the inner diameter of retainer 206 is greater than the outer diameter of the adjacent neck portion 220 so that cap 202 is able to rotate relative to slug 204, as shown in FIG. 21.

Referring now to FIG. 22, weight 230 includes a cap 232, a slug 234 and a retainer 236 that allows relative rotation between cap 232 and slug 234 in addition to relative radial, or lateral, translation. Similar to the previous embodiment, slug 234 includes a retention portion 238 that is received in a recess 240 of cap 232 and retainer 236 prevents disengagement of slug 234 from cap 232. Cap 232 includes base 242 and side wall 244 and defines recess 240. The inner surface of side wall 244 is concave and generally spherical.

Retention portion 238 includes a circumferential channel 246 that receives a portion of retainer 236. The depth of channel 246 and the inner diameter of retainer 236 are selected so that slug 234 is able to translate radially relative to retainer 236.

The outer diameter of retainer 236 is selected so that the outer edge of retainer 236 slides against the inner surface of side wall 244 in the assembled weight 238 so that the combined slug 234 and retainer 236 are able to rotate relative to cap 232.

An abutment surface 248 is provided on retention portion 238. Abutment surface 248 is a surface of retention portion 238 that abuts base 242 when weight 230 is assembled and installed in a club head. Abutment surface 248 is curved and may have any curvature, for example, abutment surface 248 may be parabolic or spherical.

Figure 23:
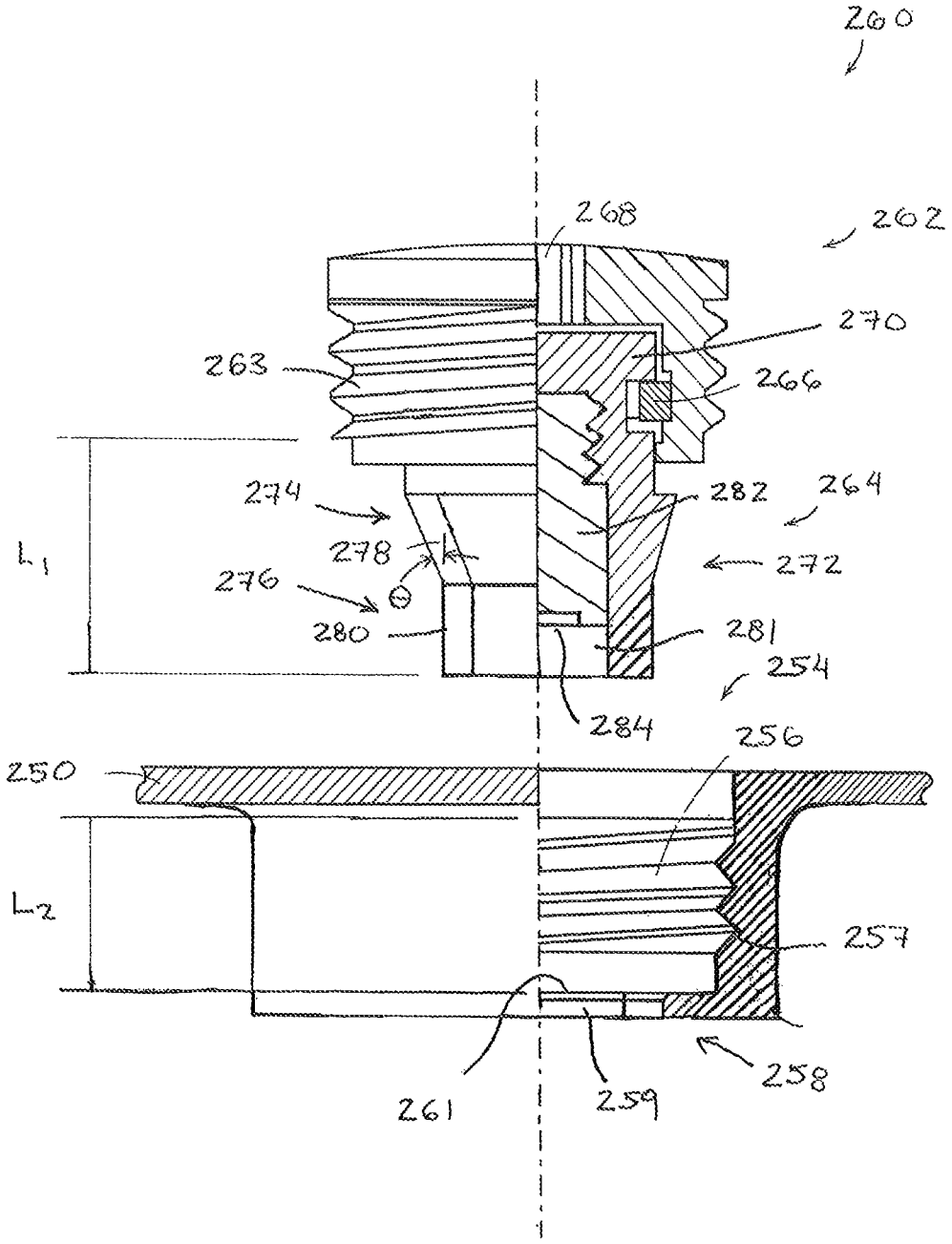
FIG. 23 is a partial cross-sectional view of a still further embodiment of a weight and a weight receptacle in a club head in accordance with the present invention.
Figure 24:
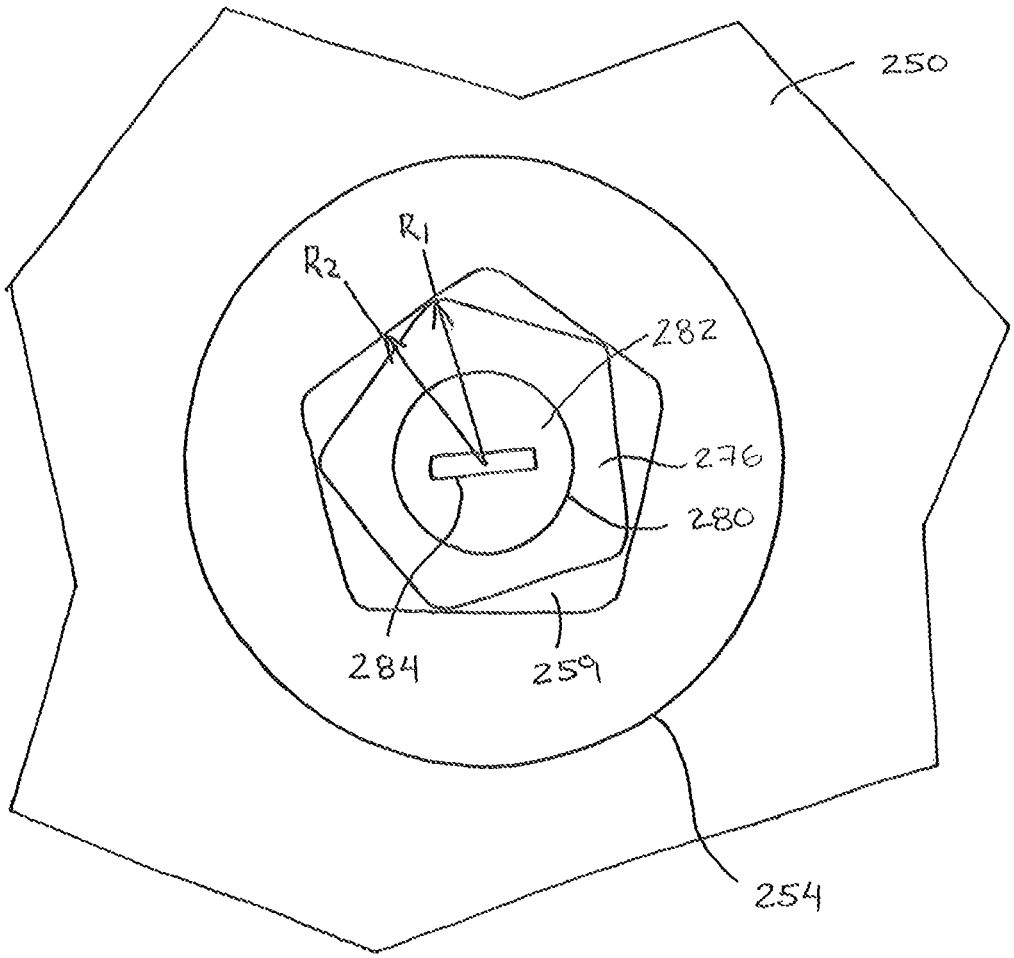
FIG. 24 is a bottom view of a portion of the weight of FIG. 23 engaging the receptacle.

Referring to FIGS. 23 and 24, a golf club head including an embodiment of a weight in accordance with the present invention will be described. Golf club head 250 generally includes a crown portion, a sole portion, a heel portion, a toe portion, a rear portion, a front portion, a hosel, and a weight 260 that is received in a weight receptacle 254.

Weight receptacle 254 is included in one of the components of club head 250 and receives weight 260. Preferably, weight receptacle 254 and weight 260 are configured so that they may removable coupled to each other. Any number of weight receptacles may be provided in the club head and each weight receptacle may be located and oriented in any way relative to the remainder of the club head. In the present embodiment, weight receptacle 254 is constructed as an integral part of club head 250, such as by casting the receptacle with the corresponding club head component.

Receptacle 254 generally includes a bore that extends through a cap portion 256 and a seat portion 258. Cap portion 256 is configured to receive, and to be removably attached to, a cap 262 included in weight 260. An inner attachment feature 257 is included in cap portion 256 that allows cap 262 to be removably coupled to the receptacle. In the present embodiment, inner attachment feature 257 is a threaded surface that engages a threaded outer surface 263 of cap 262.

Seat portion 258 of receptacle 254 is sized and shaped to receive a portion of a slug 264 that is included in weight 260. Seat portion 258 of receptacle 254 includes an anti-rotation feature that cooperates with a complementary anti-rotation feature of slug 264 to prevent relative rotation between the slug and the receptacle when the slug is received therein. For example, the seat portion of the receptacle and the extension portion of the slug preferably have a non-circular cross-sectional shape and they are sized so that relative rotation between the slug and receptacle is prevented. In the present embodiment, seat portion 258 is a flange that defines a non-circular, and more particularly, a polygonal opening 259 that is sized to receive a portion of the slug and opening 259 includes an abutment edge 261 that is configured to abut a portion of the slug. In the present embodiment, abutment edge 261 is a radiused edge that abuts the slug, but it should be appreciated that the abutment edge may be chamfered or a sharp corner if desired.

Weight 260 is assembled from cap 262 and a weight slug 264 that are movably attached by retainer 266. Cap 262 and slug 264 are coupled so that they are able to rotate relative to each other about the longitudinal axis of weight 260. The retainer also prevents relative translation between the cap and the slug along the longitudinal axis, so that the slug and cap remain engaged when the weight is separate from the receptacle and the golf club head.

Similar to previously described embodiments, cap 262 is a cup-shaped member that receives at least a portion of slug 264. A side wall of cap 262 is a generally annular wall that extends away from a base and includes a threaded outer surface 263 that mates with the threaded inner attachment feature 257 of receptacle 254. A tool engagement feature 268 is included in cap 262. The tool engagement feature mates with a tool that may be manipulated by a user to install or remove weight 260.

Slug 264 is a mass member that is movably coupled to cap 262 in weight 260. Slug 264 is a generally elongate member that includes a retention portion 270 that is coupled to cap 262 and an extension portion 272. Retention portion 270 is a generally cylindrical portion of slug 264 that is received in cap 262 and movable coupled thereto by retainer 266.

Extension portion 272 of slug 264 engages seat portion 258 of receptacle so that relative rotation between receptacle 254 and slug 264 is prevented when weight 260 is installed. In particular, extension portion 272 includes a tapered portion 274 and a lead-in portion 276. In the present embodiment, both tapered portion 274 and lead-in portion 276 have a non-circular, polygonal cross-sectional shape that complements opening 259. Tapered portion 274 includes a plurality of tapered facets 278 so that the cross-sectional shape is pentagonal and complements a pentagonal cross-sectional shape of seat portion 258 of receptacle 254. Tapered portion 274 and opening 259 are sized so that abutment edge 261 abuts an intermediate location along tapered portion 274 when cap 262 of weight 260 is engaged with cap portion 256 of receptacle 254.

The lead-in portion is provided so that during installation of the weight into a corresponding receptacle, the slug is properly oriented prior to securing the cap in the cap portion of the receptacle. As a result, binding of the weight in the receptacle in an improper orientation is prevented. Lead-in portion 276 is located and dimensioned so that it engages seat portion 258 prior to the engagement of cap 262 with cap portion 256, while preventing free relative rotation between slug 264 and receptacle 254. The outer dimension of lead-in portion 276 is selected so that it is slidably received in opening 259 while being prevented from rotating relative to the seat portion. The length $L_1$, between the distal end of the threaded surface 263 of cap 262 and the distal end of slug 264, is greater than the length $L_2$, between the proximal end of the threaded surface of cap portion 256 and the proximal end of opening 259. Additionally, the maximum radial dimension $R_1$ of lead-in portion 276 is greater than the minimum radial dimension $R_2$ of opening 259. Lead-in portion 276 extends from tapered portion 274 and is located away from retention portion 270.

In the present embodiment, lead-in portion 276 includes a plurality of facets 280 that are substantially parallel to the longitudinal axis of slug 264, but it should be appreciated that facets 280 may be tapered. As shown in FIG. 23, lead-in portion 276 has a taper angle θ (i.e., an angle relative to the longitudinal axis of the weight) of 0° so that the side walls are generally parallel to the longitudinal axis of the weight. It should be appreciated, however, that the lead-in portion may have a taper angle greater than 0°, if desired. Preferably, the lead-in portion has a taper angle that is less than the taper angle of tapered portion 274. It is also preferable that the length of the tapered portion in the direction of the longitudinal axis of the slug be less than the length of the lead-in portion.

The dimensions and material of slug 264 are selected to provide any desired mass for weight 252, and slug 264 may have a multi-material construction. For example, slug 264 includes a first mass adjustment feature, such as a bore 281 extending into slug 264 from the distal end, and an optional second mass adjustment feature, i.e., insert 282, that is received in bore 281. Insert 282 may be removably coupled to slug 264, such as by a threaded interface, and may include a tool engagement feature 284 so that insert 282 may be removed from bore 281. As alternatives, insert 282 may be retained in bore 281 by welding, brazing, an adhesive, etc.

Although the inventive weight is illustrated in a wood-type golf club, it should be appreciated that the weight may be incorporated in any type of golf club. For example, the inventive weight may be included in drivers, fairway woods, utility clubs, hybrids, iron-type golf clubs, wedges and putters.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

We claim:

1. A golf club head, comprising:

a body including a weight receptacle, wherein the weight receptacle includes a cap portion and a seat portion, wherein the cap portion is disposed proximate an outer surface of the body and the seat portion is spaced from the outer surface of the body; and a weight comprising a cap and a slug, wherein the cap includes a base and a sidewall that extends from the base to define a recess, wherein the cap is removably coupled to the cap portion of the weight receptacle, and wherein the cap comprises an aperture extending entirely through the base from an outer surface of the base to the recess of the cap, wherein the slug is an elongate member and includes a retention portion and an extension portion, wherein at least a portion of the retention portion is disposed in the recess of the cap when the weight is installed in the weight receptacle, and wherein the extension portion includes a tapered portion that is at least partially disposed in the seat portion of the weight receptacle when the weight is installed in the weight receptacle.

2. The golf club head of claim 1, wherein retention portion of the slug comprises a projection including a tapered contact surface that abuts the cap.

3. The golf club head of claim 2, wherein the cap includes a tapered contact surface that abuts the tapered contact surface of the slug.

4. The golf club head of claim 1, wherein the weight receptacle is at least partially constructed from a receptacle component that is formed separate from the body and coupled to the body, wherein the receptacle component is constructed of a material that is different than a material of the body.

5. The golf club head of claim 4, wherein the receptacle component includes a cap portion and a seat portion.

6. The golf club head of claim 4, wherein the receptacle component forms only a portion of the weight receptacle.

7. The golf club head of claim 6, wherein the receptacle component forms only the cap portion.

8. The golf club head of claim 6, wherein the receptacle component forms only the seat portion.

9. The golf club head of claim 4, wherein the receptacle component is threaded to the body.

10. The golf club head of claim 4, wherein the receptacle component is bonded to the body.

11. The golf club head of claim 4, wherein the receptacle component is staked to the body.

12. The golf club head of claim 1, wherein the weight further comprises a compression member disposed between the base of the cap and the retention portion of the slug, wherein the compression member is an elastic member that is compressed when the weight is installed in the weight receptacle.

13. A golf club head, comprising:

a body including a weight receptacle, wherein the weight receptacle includes a cap portion and a seat portion, wherein the cap portion is disposed proximate an outer surface of the body and the seat portion is spaced from the outer surface of the body; and a weight comprising a cap and a slug, wherein the cap includes a base and a sidewall that extends from the base to define a recess, wherein the cap is removably coupled to the cap portion of the weight receptacle, wherein the slug is an elongate member and includes a retention portion and an extension portion, wherein at least a portion of the retention portion is disposed in the recess of the cap, and wherein the extension portion includes a tapered portion that is at least partially disposed in the seat portion of the weight receptacle when the weight is installed in the weight receptacle, wherein retention portion of the slug comprises a projection including a tapered contact surface that abuts the cap, and wherein the cap includes a tapered contact surface that abuts the tapered contact surface of the slug.

14. The golf club head of claim 13, wherein the weight receptacle is at least partially constructed from a receptacle component that is formed separate from the body and coupled to the body, wherein the receptacle component is constructed of a material that is different than a material of the body.

15. The golf club head of claim 14, wherein the receptacle component is threaded to the body.

16. The golf club head of claim 14, wherein the receptacle component is bonded to the body.

17. A golf club head, comprising:

a body including a weight receptacle, wherein the weight receptacle includes a cap portion and a seat portion, wherein the cap portion is disposed proximate an outer surface of the body and the seat portion is spaced from the outer surface of the body; and a weight comprising a cap and a slug, wherein the cap includes a base and a sidewall that extends from the base to define a recess, wherein the cap is removably coupled to the cap portion of the weight receptacle, wherein the slug is an elongate member and includes a retention portion and an extension portion, wherein at least a portion of the retention portion is disposed in the recess of the cap, and wherein the extension portion includes a tapered portion that is at least partially disposed in the seat portion of the weight receptacle when the weight is installed in the weight receptacle, wherein the weight receptacle is at least partially constructed from a receptacle component that is formed separate from the body and coupled to the body, wherein the receptacle component is constructed of a material that is different than a material of the body, and wherein the receptacle component is bonded to the body.

18. The golf club head of claim 17, wherein the receptacle component forms only a partial weight receptacle.

19. The golf club head of claim 18, wherein the receptacle component forms only the cap portion.

20. The golf club head of claim 18, wherein the receptacle component forms only the seat portion.

* * * * *